US009938695B2

(12) United States Patent
Bjerke et al.

(10) Patent No.: US 9,938,695 B2
(45) Date of Patent: Apr. 10, 2018

(54) SHROUD RETENTION SYSTEM FOR A WORK TOOL

(71) Applicant: Caterpillar Inc., Peoria, IL (US)

(72) Inventors: Nathan R. Bjerke, Peoria, IL (US); Thomas M. Congdon, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 15/143,945

(22) Filed: May 2, 2016

(65) Prior Publication Data

US 2017/0073939 A1 Mar. 16, 2017

Related U.S. Application Data

(60) Provisional application No. 62/216,509, filed on Sep. 10, 2015.

(51) Int. Cl.
*E02F 9/28* (2006.01)

(52) U.S. Cl.
CPC ..... *E02F 9/2816* (2013.01); *E02F 9/2808* (2013.01); *E02F 9/2841* (2013.01); *E02F 9/2883* (2013.01); *E02F 9/2825* (2013.01); *E02F 9/2833* (2013.01)

(58) Field of Classification Search
CPC ..... E02F 9/28–9/2883; B25B 27/143; F16B 37/041; F16B 37/044
See application file for complete search history.

(56) References Cited

U.S. PATENT DOCUMENTS 4,205,469 A * 6/1980 Johansson ..... E02F 3/9212 37/457
4,676,706 A * 6/1987 Inaba ..... F16B 37/041 411/175
5,125,853 A * 6/1992 Hashiguchi ..... H01R 23/6873 439/607.26
5,713,145 A * 2/1998 Ruvang ..... E02F 9/2833 37/455
5,778,599 A * 7/1998 Saito ..... E05F 11/385 49/375
5,937,550 A 8/1999 Emrich
6,209,238 B1 * 4/2001 Ruvang ..... E02F 9/2825 37/455
6,240,663 B1 6/2001 Robinson
7,219,454 B2 * 5/2007 Maher ..... E02F 9/2833 172/753

(Continued)

FOREIGN PATENT DOCUMENTS

WO 2013122561 8/2013

*Primary Examiner* — Matthew D Troutman
(74) *Attorney, Agent, or Firm* — Finnegan, Henderson, Farabow, Garrett & Dunner, LLP

(57) ABSTRACT

A shroud for a work tool is disclosed. The shroud may have a tip portion. The tip portion may have a tip extending from a shroud proximal end to a tip end disposed between the shroud proximal end and a shroud distal end. The tip portion may further have an upper leg extending from the tip end to an upper leg distal end. The tip portion may also have a lower leg extending from the tip end to a lower leg distal end. The lower leg may be spaced apart from the upper leg to form an opening between the upper leg and the lower leg. The shroud may have an attachment portion attached to the upper leg. The attachment portion may extend from adjacent the tip end to the shroud distal end.

12 Claims, 11 Drawing Sheets

(56) References Cited

U.S. PATENT DOCUMENTS

| | | | | |
|---|---|---|---|---|
| 7,472,503 | B2 * | 1/2009 | Maher | E02F 9/2841 37/452 |
| 8,024,874 | B2 | 9/2011 | McClanahan et al. | |
| 8,438,760 | B2 * | 5/2013 | Maher | E02F 9/2841 37/457 |
| 8,943,718 | B2 * | 2/2015 | Ruvang | E02F 9/2841 37/458 |
| 9,540,796 | B2 * | 1/2017 | Dallard | E02F 9/2833 |
| 2003/0089003 | A1 * | 5/2003 | Ollinger, IV | E02F 9/2825 37/452 |
| 2003/0121185 | A1 * | 7/2003 | Ollinger, IV | E02F 9/2825 37/457 |
| 2004/0237355 | A1 * | 12/2004 | Ollinger, IV | E02F 9/2825 37/452 |
| 2005/0229441 | A1 | 10/2005 | Maher | |
| 2008/0005940 | A1 * | 1/2008 | Ollinger | E02F 9/2825 37/452 |
| 2009/0282711 | A1 * | 11/2009 | Naher | E02F 9/2841 37/455 |
| 2009/0285651 | A1 * | 11/2009 | Cooley | B29C 45/2618 411/106 |
| 2013/0185964 | A1 | 7/2013 | Anisy et al. | |
| 2014/0173949 | A1 | 6/2014 | Karlsson et al. | |
| 2014/0202049 | A1 * | 7/2014 | Ruvang | E02F 9/2841 37/453 |
| 2014/0360060 | A1 | 12/2014 | Kunz | |
| 2015/0211214 | A1 * | 7/2015 | Dallard | E02F 9/2833 37/456 |

* cited by examiner

SHROUD RETENTION SYSTEM FOR A WORK TOOL

RELATED APPLICATION

This application is based on and claims benefit of priority of U.S. Provisional Patent Application No. 62/216,509, filed Sep. 10, 2015, which is incorporated herein by reference.

TECHNICAL FIELD

The present disclosure relates generally to a shroud retention system and, more particularly, to a shroud retention system for a work tool.

BACKGROUND

Earth-working machines, such as excavators, shovels, and wheel loaders, include ground engaging work tools that engage with and/or move a variety of earthen materials. These work tools often have one or more cutting tools or tooth assemblies mounted to an edge of the work tool, for example, to a lip of a bucket. The exposed portions of the work tool edge between adjacent tooth assemblies come into contact with the ground or the earthen materials and are subjected to extreme abrasion and impacts that cause them to wear. To prolong the useful life of the work tools, wear members or shrouds are attached to the work tools between adjacent tooth assemblies to protect the exposed portions of the work tool edge.

Although the wear members protect the edge of the work tool, the wear members are still subject to severe abrasion and may need periodic repair or replacement. Removal and/or replacement of a wear member may require disassembly of the wear members from the edge of the work tool, and assembly of a repaired or a new wear member on the work tool. The machine must be taken out of service to perform such replacement or repair. The time required to disassemble and reassemble a wear member may be dictated by the mechanism used to retain the wear member on the work tool. It is desirable to have a retention system that allows for quick assembly and disassembly at a worksite to allow the machine to be returned to service as quickly as possible.

U.S. Pat. No. 6,240,663 of Robinson, issued on Jun. 5, 2001 ("the '663 patent"), discloses a resilient connection system for attaching a wear member to an excavating lip structure. In particular, the '663 patent discloses a wear member that has a front portion with two rearwardly extending legs including an upper leg which is disposed on top of a lip of a bucket and a lower leg, which is disposed below the lip. The '663 patent further discloses that a connection member is welded to the bucket. The connection member includes an upstanding boss that includes a circular opening. Likewise, the upper leg of the wear member of the '663 patent includes a projection. A fastener passing through the circular opening in the boss engages with the projection in the upper leg to attach the wear member to the connection member. The connection member of the '663 patent also includes two spring assemblies disposed on either side of the fastener. Each spring assembly includes a rod attached at one end to the connection member and a spring circumscribed around the rod. The spring is retained at the other end of the rod by a snap ring. The rods in each spring assembly of the '663 patent engage with openings in downwardly projecting bosses of the upper leg of the wear member so that the springs are retained between the bosses and the connection member. As the fastener is tightened, the spring assemblies of the '663 patent are compressed providing a biasing force to urge the wear member onto the lip. The '663 patent also discloses that a protective shroud is installed to protect the components of the retention system.

Although the '663 patent discloses a resilient wear member retention system, the disclosed retention system may not be optimal. For example, assembly of the wear member using the system of the '663 patent requires multiple features of the wear member to engage with corresponding features of the connection member, making the assembly cumbersome. In particular, the system of the '663 patent requires a projection in the wear member leg to engage with a fastener attached to the connection member, while simultaneously requiring two bosses in the leg to engage with spring assemblies in the connection member. Disassembly of the wear member may also be cumbersome because of the need to loosen the fastener and disengage the wear member from the fastener and the two spring assemblies for removal. Further, the retention system of the '663 member requires a fastener, two separate spring assemblies, and a protective shroud. The large number of parts required for assembly may increase the cost of manufacturing and maintaining the retention system of the '663 patent.

The shroud retention system of the present disclosure solves one or more of the problems set forth above and/or other problems of the prior art.

SUMMARY

In one aspect, the present disclosure is directed to a shroud for a work tool. The shroud may include a tip portion. The tip portion may include a tip extending from a shroud proximal end to a tip end disposed between the shroud proximal end and a shroud distal end. The tip portion may further include an upper leg extending from the tip end to an upper leg distal end. The tip portion may also include a lower leg extending from the tip end to a lower leg distal end. The lower leg may be spaced apart from the upper leg to form an opening between the upper leg and the lower leg. The shroud may include an attachment portion attached to the upper leg. The attachment portion may extend from adjacent the tip end to the shroud distal end.

In another aspect, the present disclosure is directed to a slide compressor for attaching a work tool. The slide compressor may include a central block. The central block may include a compressor front face and a compressor rear face disposed opposite the front face. The compressor rear face may be inclined relative to the compressor front face. The central block may further include a compressor bottom face extending between the compressor front face and the compressor rear face. The central block may also include a compressor top face disposed opposite the compressor bottom face and extending between the compressor front face and the compressor rear face. The central block may include a hole extending between the compressor front face and the compressor rear face. In addition, the central block may include a slot extending from the compressor top face towards the compressor bottom face. The slot may intersect with the hole.

In yet another aspect, the present disclosure is direct to a retainer plate. The retainer may include a retainer front face and a retainer rear face disposed opposite the retainer front face. The retainer may include a retainer portion and a pull out portion. The retainer portion may include a retainer bottom face extending between the retainer front face and the retainer rear face. The retainer portion may further include a retainer top face extending between the retainer front face and the retainer rear face. The retainer portion may also include retainer side faces extending between the retainer front face and the retainer rear face. The pull out portion may extend from the retainer portion. The pull out portion may include a top wall disposed generally parallel to the retainer top face. The pull out portion may further include a first side wall connecting the top wall to the retainer top face. The pull out portion may also include a second side wall connecting the top wall to the retainer top face. The retainer plate may include a first slot extending from the retainer bottom face towards the retainer top face. The retainer plate may also include a second slot disposed between the first slot and the top wall of the pullout portion.

DETAILED DESCRIPTION

Figure 1:
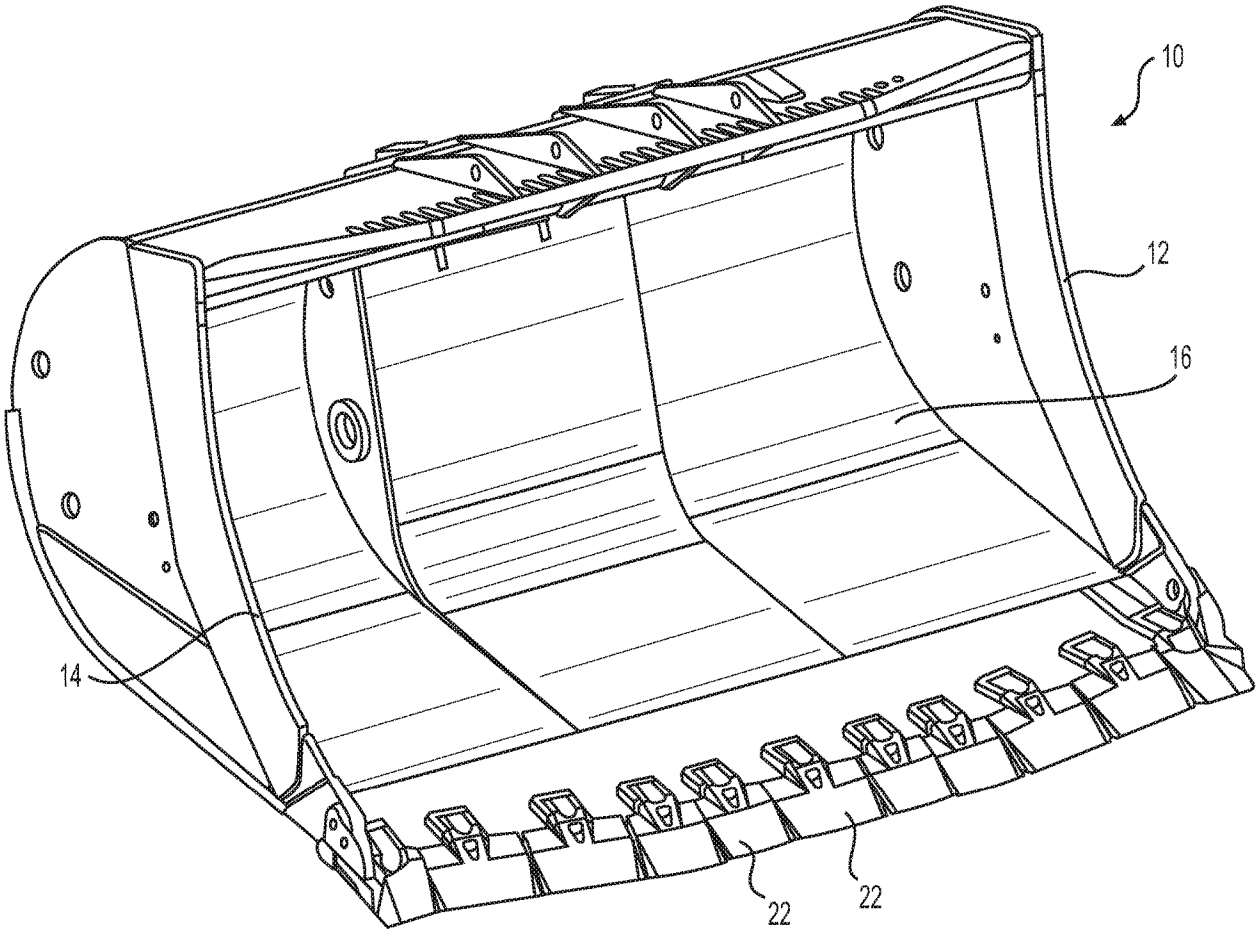
FIG. 1 is an illustration of an exemplary work tool.

FIG. 1 illustrates an exemplary work tool 10 for a machine (not shown). Work tool 10 may embody any device used to perform a task assigned to the machine. For example, work tool 10 may be a bucket (shown in FIG. 1), a blade, a shovel, a crusher, a grapple, a ripper, or any other material moving device known in the art. Work tool 10 may include side walls 12, 14, and primary wall 16, which may form a bottom of work tool 10. Primary wall 16 may extend from side wall 12 to side wall 14. Primary wall 16 of work tool 10 may also include edge 18 (see FIG. 2), extending between side walls 12, 14. Edge 18 may be detachable from work tool 10 or it may be a fixed component of work tool 10.

Work tool 10 may include a plurality of shrouds 22 (or wear members) attached to edge 18. Each shroud 22 may be configured to protect edge 18 from abrasion and wear by reducing or preventing contact of an exposed portion of edge 18 with earthen materials. In some exemplary embodiments, shrouds 22 may be disposed between adjacent tool assemblies (not shown) attached to edge 18 to protect a portion of edge 18 between the adjacent tool assemblies from abrasion and wear.

For the purposes of this disclosure, attention will be focused on attachment of shrouds 22 to work tool 10. It is contemplated, however, that the attachment methods and structures presented in this disclosure may be equally utilized with tool assemblies, other wear components, and/or with any other wear components known in the art.

Figure 2:
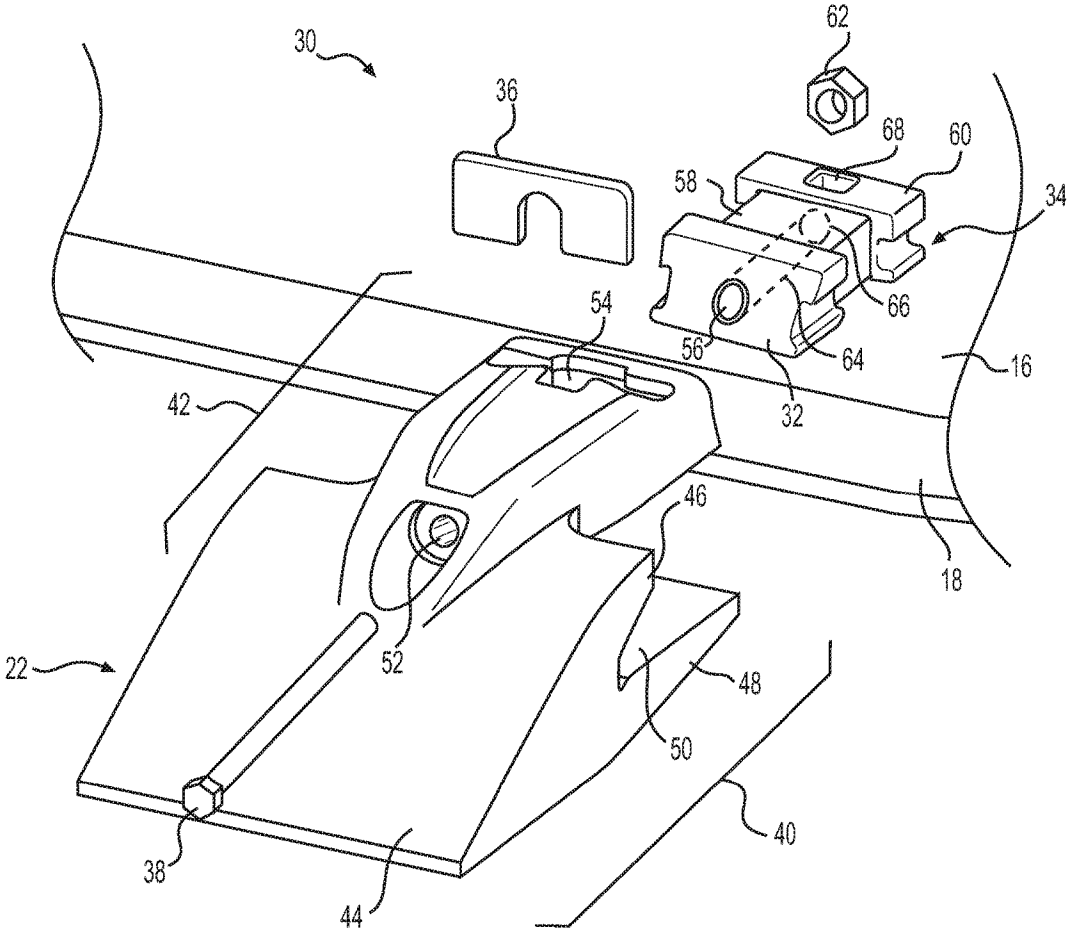
FIG. 2 is an illustration of an exemplary shroud retention system for the work tool of FIG. 1.

FIG. 2 illustrates an exemplary shroud retention system 30 for attaching shroud 22 to work tool 10. Shroud retention system 30 may include adapter 32, spring assembly 34, retainer plate 36, and bolt 38. Shroud 22 may include tip portion 40 and attachment portion 42. Tip portion 40 may be generally U-shaped and may include tip 44, upper leg 46, and lower leg 48. Upper and lower legs 46, 48 may extend in a direction away from tip 44. Upper and lower legs 46, 48 may be spaced apart from each other to form opening 50 that may be large enough to receive edge 18 of work tool 10. Attachment portion 42 may be attached to upper leg 46 of tip portion 40. Like upper and lower legs 46, 48, attachment portion 42 may extend in a direction away from tip 44. Attachment portion 42 may include hole 52 configured to receive bolt 38. Attachment portion 42 may also include opening 54 configured to slidably receive retainer plate 36.

Adapter 32 may be attached to primary wall 16 of work tool 10. Adapter 32 may be configured to be slidably received in attachment portion 42. Adapter 32 may include hole 56 configured to receive bolt 38. Spring assembly 34 may be disposed adjacent adapter 32. Spring assembly 34 may be attached to adapter 32 and may include spring damper 58, slide compressor 60, and nut 62. As illustrated in FIG. 2, spring damper 58 may be disposed between adapter 32 and slide compressor 60. Spring damper 58 may include hole 64 configured to receive bolt 38. Slide compressor 60 may be configured to be slidably received in attachment portion 42. Slide compressor 60 may include hole 66 configured to receive bolt 38. Slide compressor 60 may also include slot 68, which may be configured to receive nut 62. Bolt 38 may pass through hole 52 in attachment portion 42 of shroud 22, hole 56 in adapter 32, hole 64 in spring damper 58, and hole 66 in slide compressor 60 to threadingly engage with nut 62 disposed within slot 68. Slide compressor 60 may be configured to slidably movable relative to adapter 32. For example, slide compressor 60 may be configured to slidably move towards adapter 32 when bolt 38 is turned to engage with nut 62, compressing spring damper 58 disposed between adapter 32 and slide compressor 60.

Figure 3:
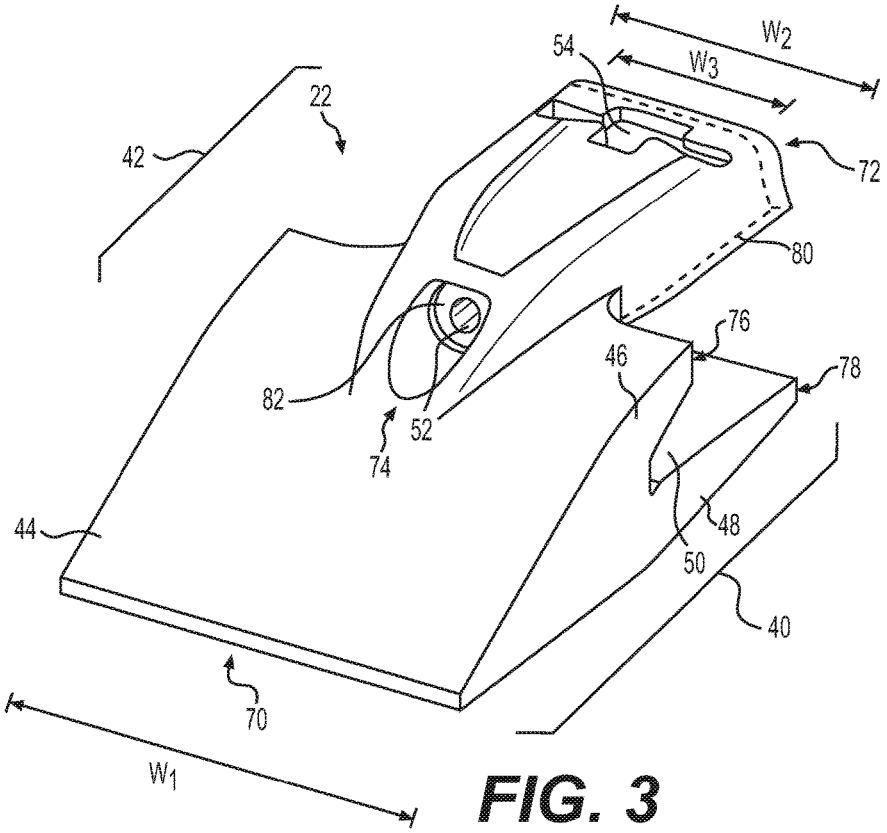
FIG. 3 is a perspective view of an exemplary shroud for the shroud retention system of FIG. 2.

FIG. 3 illustrates a perspective view of shroud 22, which may extend from adjacent shroud proximal end 70 to adjacent shroud distal end 72. Tip 44 of shroud 22 may extend from adjacent shroud proximal end 70 to adjacent tip end 74. Tip 44 may be generally wedge shaped with a thickness adjacent shroud proximal end 70, which may be smaller than a thickness of tip 44 adjacent tip end 74. Upper leg 46 of tip portion 40 may extend from tip end 74 to upper leg distal end 76, which may be disposed between tip end 74 and shroud distal end 72. Lower leg 48 of tip portion 40 may extend from tip end 74 to lower leg distal end 78, which may be disposed between tip end 74 and shroud distal end 72. Upper leg 46 may be spaced apart from lower leg 48, forming opening 50 between upper and lower legs 46, 48. Upper and lower legs 46, 48 may be wedge shaped. For example, a thickness of upper leg 46 adjacent tip end 74 may be larger than a thickness of upper leg 46 adjacent upper leg distal end 76. Likewise, a thickness of lower leg 48 adjacent tip end 74 may be larger than a thickness of lower leg 48 adjacent lower leg distal end 78. Tip 44, upper leg 46, and lower leg 48 may each have a width "$W_1$."

Attachment portion 42 may be attached to tip portion 40. In one exemplary embodiment as illustrated in FIG. 3, attachment portion 42 may be attached to upper leg 46 and may extend from adjacent tip end 74 to shroud distal end 72. Attachment portion 42 may have a width "$W_2$" adjacent shroud distal end 72. In one exemplary embodiment as illustrated in FIG. 3, width $W_2$ may be smaller than width $W_1$. Attachment portion 42 may include a channel 80 (see dashed lines), which may extend from adjacent tip end 74 to shroud distal end 72. Channel 80 may have a generally inverted C-shape and may be configured to slidably engage with adapter 32 and slide compressor 60. Attachment portion 42 may also include channel front wall 82 adjacent tip end 74. Channel front wall 82 may include hole 52, which may be a through hole. Hole 52 may be sized to receive bolt 38, which may pass through hole 52 and extend into channel 80. As also illustrated in FIG. 3, attachment portion 42 may include opening 54, which may be configured to receive retainer plate 36. Opening 54 may be disposed adjacent shroud distal end 72 across a width of attachment portion 42. In one exemplary embodiment as illustrated in FIG. 3, opening 54 may be disposed nearer to shroud distal end 72 compared to tip end 74. Opening 54 may have a width "$W_3$," which may be smaller than a width $W_2$ of attachment portion 42. Width $W_3$ of opening 54 may be selected to allow retainer plate 36 to pass through opening 54 into channel 80.

Figure 4:
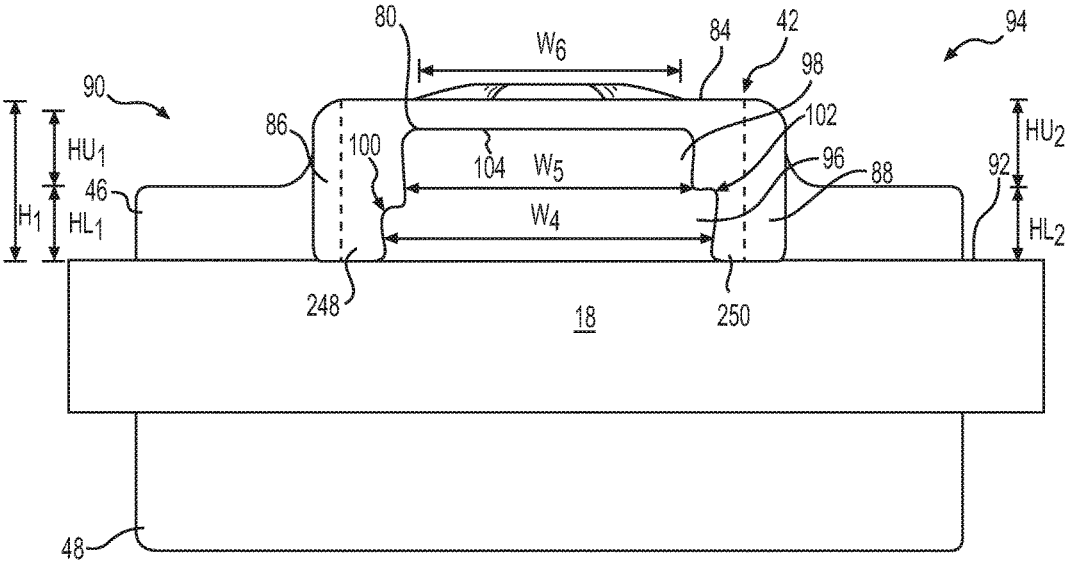
FIG. 4 is rear view of the exemplary shroud of FIG. 3.

FIG. 4 illustrates a rear view of shroud 22. As illustrated in FIG. 4, channel 80 of attachment portion 42 may have a generally inverted C-shape having top wall 84, first leg 86, and second leg 88. First leg 86 may extend from top wall 84 towards edge 18 of work tool 10. First leg 86 may be disposed on first side 90 of channel 80 and may extend from top wall 84 to adjacent upper surface 92 of edge 18. Second leg 88 may extend from top wall 84 towards edge 18 of work tool 10. Second leg 88 may be disposed opposite first leg 86 on second side 94. Second leg 88 may extend from top wall 84 to adjacent upper surface 92 of edge 18. Channel 80 may have a height "$H_1$" and may include lower recess 96 and upper recess 98, both of which together may form channel 80. Lower recess 96 may extend from adjacent upper surface 92 to first lower recess end 100 on first side 90 and second lower recess end 102 on second side 94. Lower recess 96 may have a height "$HL_1$" adjacent first leg 86 and height "$HL_2$" adjacent second leg 88. Heights $HL_1$ and $HL_2$ may be equal or unequal and may be smaller than height $H_1$ of channel 80. Lower recess 96 may have a width "$W_4$" adjacent upper surface 92 and a width "$W_5$" adjacent first and second lower recess ends 100, 102. In one exemplary embodiment as illustrated in FIG. 4, width $W_5$ may be smaller than width $W_4$ giving lower recess 96 a generally inverted trapezoidal or dovetail shape.

Upper recess 98 may extend from first and second lower recess ends 100, 102 to channel inner wall 104. Upper recess 98 may have a height "$HU_1$" adjacent first leg 86 and a height "$HU_2$" adjacent second leg 88. Heights $HU_1$ and $HU_2$ may be smaller than height $H_1$ of channel 80. Further, heights $HU_1$, $HU_2$, $HL_1$, and $HL_2$ may be equal or unequal. Upper recess 98 may have a width $W_6$ adjacent top wall 84. In one exemplary embodiment as illustrated in FIG. 4, width $W_6$ may be larger than width $W_5$ giving upper recess 98 a generally inverted trapezoidal or dovetail shape. Lower and upper recesses 96, 98 of channel 80 may be configured to slidably receive adapter 32 and slide compressor 60.

Figure 5:
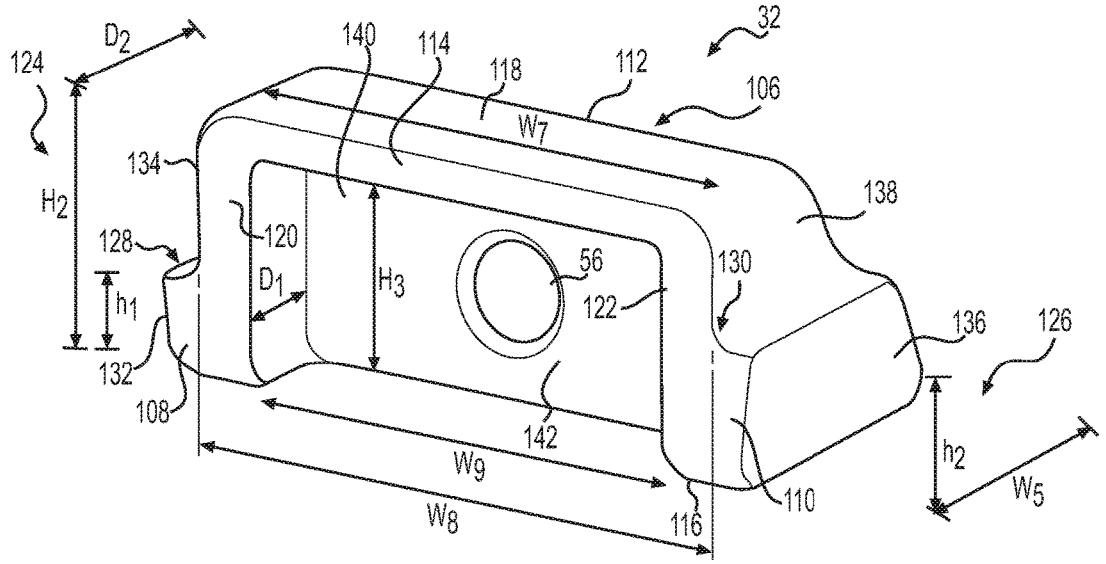
FIG. 5 is a perspective view of an exemplary adapter for the shroud retention system of FIG. 2.

FIG. 5 illustrates a perspective view of an exemplary disclosed adapter 32. Adapter 32 may include central block 106, first projection 108, and second projection 110. Central block 106 may include adapter front face 112 and adapter rear face 114 disposed opposite adapter front face 112. Adapter rear face 114 may be spaced apart from adapter front face 112. Central block 106 may include adapter bottom face 116 that may extend between adapter front face 112 and adapter rear face 114. Adapter bottom face 116 may be configured to abut against upper surface 92 of work tool 10. Central block 106 may include adapter top face 118 that may extend between adapter front face 112 and adapter rear face 114. Adapter top face 118 may be disposed opposite adapter bottom face 116. Adapter rear face 114 may be disposed generally orthogonal to adapter bottom face 116 and adapter top face 118.

Adapter 32 may include first adapter side wall 120 and second adapter side wall 122. First adapter side wall 120 may be disposed on first side 124 of adapter 32 and may extend between adapter front face 112 and adapter rear face 114. Second adapter side wall 122 may be disposed on second side 126 of adapter 32 opposite first side 124. Second adapter side wall 122 may also extend between adapter front face 112 and adapter rear face 114. First and second adapter side walls 120, 122 may be disposed generally orthogonal to adapter front face 112, adapter rear face 114, adapter bottom face 116, and adapter top face 118. Adapter 32 may have a height "$H_2$," which may be smaller than height $H_1$ of channel 80 to allow channel 80 to slidably engage with adapter 32.

First projection 108 may extend outward from central block 106. First projection 108 may be disposed generally orthogonal to first adapter side wall 120. First projection may have a height "$h_1$," between adapter bottom face 116 and first projection end 128. Height $h_1$ may be smaller than height $H_2$ of adapter 32. Second projection 110 may be disposed opposite first projection 108 and may extend outward from central block 106. Second projection 110 may be disposed generally orthogonal to second adapter side wall 122. Second projection may have a height "$h_2$," between adapter bottom face 116 and second projection end 130. Height $h_2$ may be smaller than height $H_2$ of adapter 32. It is also contemplated that height $h_2$ may be the same as or different from height $h_1$.

First projection 108 may have a first lower side face 132, which may extend from adapter bottom face 116 to first projection end 128. First adapter side wall 120 may include a first upper side face 134, which may extend from first projection end 128 to adapter top face 118. Second projection 110 may have a second lower side face 136, which may extend from adapter bottom face 116 to second projection end 130. Second adapter side wall 122 may include second upper side face 138, which may extend from second projection end 130 to adapter top face 118. First and second lower side faces 132, 136 may be inclined relative to each other and relative to adapter bottom face 116 and adapter top face 118. Likewise, first and second upper side faces 134, 138 may be inclined relative to each other and relative to adapter bottom face 116 and adapter top face 118. Adapter bottom face 116, first lower side face 132, and second lower side face 136 may be arranged so that first and second projections 108, 110 may form a dovetail mortice shape, which may be slidably received in lower recess 96 of channel 80. Likewise, first and second upper side faces 134, 138 may be arranged so that central block 106 may form a dovetail mortice shape, which may be slidably received in upper recess 98 of channel 80. Adapter 32 may have a width "$W_7$" adjacent adapter top face 118 and a width "$W_8$" between first and second projection ends 128, 130. Widths $W_7$ and $W_8$ may be less than widths $W_6$ and $W_5$, respectively, to allow adapter 32 to be slidably received within channel 80 of shroud 22.

Adapter 32 may include recess 140, which may extend from adapter rear face 114 into adapter 32 towards adapter front face 112. Recess 140 may have a recess base 142, which may be disposed generally parallel to adapter rear face 114. Recess 140 may have a depth "$D_1$," between adapter rear face 114 and recess base 142. Depth $D_1$ may be smaller than a thickness "$D_2$" of adapter 32. Recess 140 may have a height "$H_3$" and a width "$W_9$." Height $H_3$ and width $W_9$ may be selected such that one end of spring damper 58 may be slidably retained within recess 140. Adapter 32 may include hole 56, which may extend from recess base 142 to adapter front face 112. In one exemplary embodiment as illustrated in FIG. 4, hole 56 may be a through hole and may have a generally circular cross-section. It is contemplated, however, that hole 56 may be tapped to threadingly receive bolt 38.

Figure 6:
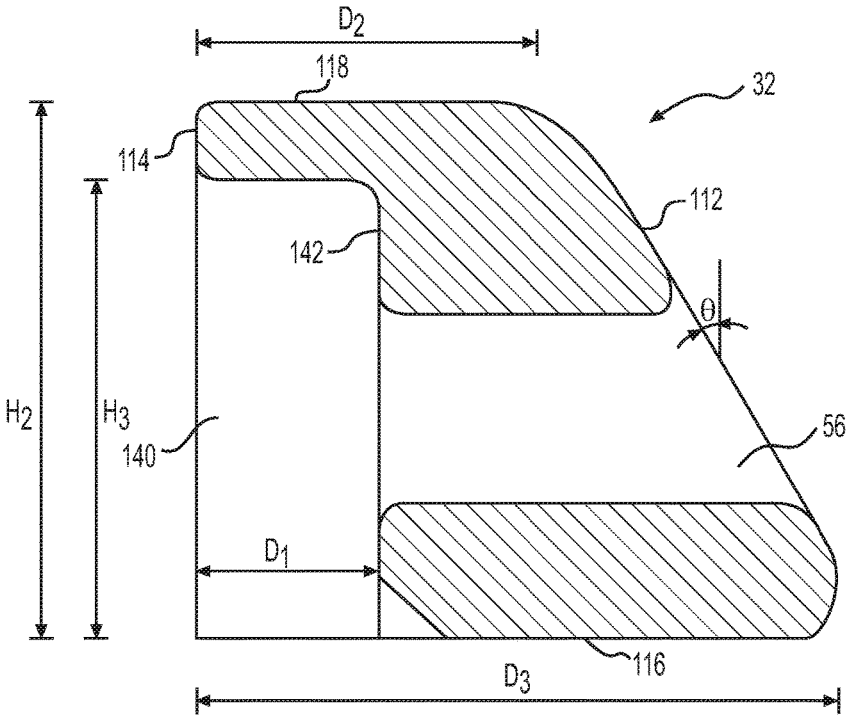
FIG. 6 is a cross-sectional view of the exemplary adapter of FIG. 5.

FIG. 6 illustrates a vertical cross-sectional view of adapter 32. As illustrated in FIG. 6, adapter front face 112 may be generally inclined relative to adapter bottom face 116, adapter top face 118, adapter rear face 114, and recess base 142. In one exemplary embodiment, adapter front face 112 may be inclined towards adapter rear face 114 so that thickness $D_2$ of adapter 32 adjacent adapter top face 118 may be smaller than thickness "$D_3$" of adapter 32 adjacent adapter bottom face 116. Angle of inclination θ of adapter front face 112 relative to a vertical plane disposed generally parallel to adapter rear face 114 may range between about 15° to 30°. As used in this disclosure, the terms "about" and "generally" indicate typical manufacturing tolerances and dimensional rounding.

Figure 7:
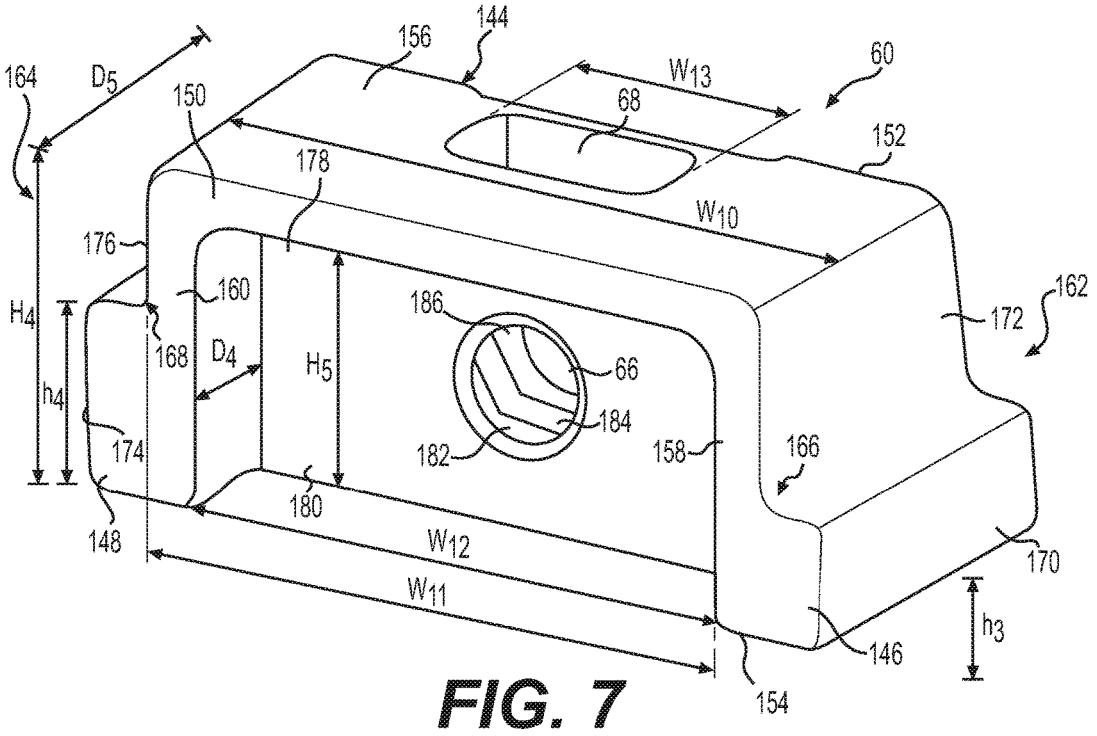
FIG. 7 is a perspective view of an exemplary slide compressor for the shroud retention system of FIG. 2.

FIG. 7 illustrates a perspective view of an exemplary disclosed slide compressor 60. Slide compressor 60 may include central block 144, first projection 146, and second projection 148. Central block 144 may include compressor front face 150 and compressor rear face 152 disposed opposite compressor front face 150. Compressor rear face 152 may be spaced apart from compressor front face 150. Central block 144 may include compressor bottom face 154 that may extend between compressor front face 150 and compressor rear face 152. Compressor bottom face 154 may be configured to slidably engage with upper surface 92 of work tool 10. Central block 144 may include compressor top face 156 that may extend between compressor front face 150 and compressor rear face 152. Compressor top face 156 may be disposed opposite compressor bottom face 154. Compressor front face 150 may be disposed generally orthogonal to compressor bottom face 154 and compressor top face 156.

Slide compressor 60 may include first compressor side wall 158 and second compressor side wall 160 disposed opposite first compressor side wall 158. First compressor side wall 158 may be disposed on first side 162 of slide compressor 60 and may extend between compressor front face 150 and compressor rear face 152. Second compressor side wall 160 may be disposed on second side 164 of slide compressor 60 opposite first side 162. Second compressor side wall 160 may extend between compressor front face 150 and compressor rear face 152. First and second compressor side walls 158, 160 may be disposed generally orthogonal to compressor front face 150, compressor rear face 152, compressor bottom face 154, and compressor top face 156. Slide compressor 60 may have a height "$H_4$," which may be smaller than height $H_1$ of channel 80 to allow channel 80 to slidably engage with slide compressor 60.

First projection 146 may extend outward from central block 144. First projection 146 may be disposed generally orthogonal to first compressor side wall 158. First projection may have a height "$h_3$," between compressor bottom face 154 and first projection end 166. Height $h_3$ may be smaller than height $H_4$ of slide compressor 60. Second projection 148 may be disposed opposite first projection 146 and may extend outward from central block 144. Second projection 148 may be disposed generally orthogonal to second compressor side wall 160. Second projection may have a height "$h_4$," between compressor bottom face 154 and second projection end 168. Height $h_4$ may be smaller than height $H_2$. It is also contemplated that height $h_4$ may be the same as or different from height $h_3$.

First projection 146 may include first lower side face 170, which may extend from compressor bottom face 154 to first projection end 166. First compressor side wall 158 may include first upper side face 172, which may extend from first projection end 166 to compressor top face 156. Second projection 148 may have a second lower side face 174, which may extend from compressor bottom face 154 to second projection end 168. Second compressor side wall 160 may include second upper side face 176, which may extend from second projection end 168 to compressor top face 156. First and second lower side faces 170, 174 may be inclined relative to each other and relative to compressor bottom face 154 and compressor top face 156. Likewise, first and second upper side faces 172, 176 may be inclined relative to each other and relative to compressor bottom face 154 and compressor top face 156. Compressor bottom face 154, first lower side face 170, and second lower side face 174 may be arranged so that first and second projections 146, 148 may form a dovetail mortice shape, which may be slidably received in lower recess 96 of channel 80. Likewise, first and second upper side faces 172, 176 may be arranged so that central block 144 may form a dovetail mortice shape, which may be slidably received in upper recess 98 of channel 80. Slide compressor 60 may have a width "$W_{10}$" adjacent compressor top face 156 and a width "$W_{11}$" between first and second projection ends 166, 168. Widths $W_{10}$ and $W_{11}$ may be less than widths W6 and W5, respectively, to allow slide compressor 60 to be slidably received within channel 80 of shroud 22.

Slide compressor 60 may include recess 178, which may extend from compressor front face 150 into slide compressor 60 towards compressor rear face 152. Recess 178 may have a recess base 180, which may be disposed generally parallel to compressor front face 150. Recess 178 may have a depth "$D_4$," between compressor front face 150 and recess base 180. Depth $D_4$ may be smaller than a thickness "$D_5$" of slide compressor 60. Recess 178 may have a height "$H_5$" and a width "$W_{12}$." Height $H_5$ and width $W_{12}$ may be selected such that one end of spring damper 58 may be slidably retained within recess 178. It is contemplated that height $H_5$ of recess 178 may be the same as or different from height $H_3$ of recess 140. Likewise, it is contemplated that width $W_{12}$ of recess 178 may be the same as or different from width $W_9$ of recess 140.

Slide compressor 60 may include hole 66, which may extend between compressor front face 150 and compressor rear face 152. In one exemplary embodiment as illustrated in FIG. 7, hole 66 may extend from recess base 180 to compressor rear face 152. Hole 66 may have a first hole portion 182, a second hole portion 184, and a third hole portion 186. First hole portion 182 and third hole portion 186 may be through holes and may have a generally circular cross-section. It is contemplated that first and third hole portions 182, 186 may be tapped to threadingly receive nut 62. Second hole portion 184 may have a generally non-circular cross-section. Slide compressor 60 may include slot 68 on compressor top face 156. Slot 68 may extend from compressor top face 156 towards compressor bottom face 154 and may intersect with hole 66. Slot 68 may intersect with second hole portion 184, which may be configured to slidably receive nut 62 through slot 68. The non-circular cross-section of second hole portion 184 may help prevent rotation of nut 62 within second hole portion 184. Slot 68 may be disposed nearer compressor rear face 152 relative to compressor front face 150. In one exemplary embodiment as illustrated in FIG. 7, slot 68 may have a generally rectangular cross-section. Slot 68 may have a width "$W_{13}$," which may be selected such that nut 62 may be receivable within slot 68.

Figure 8:
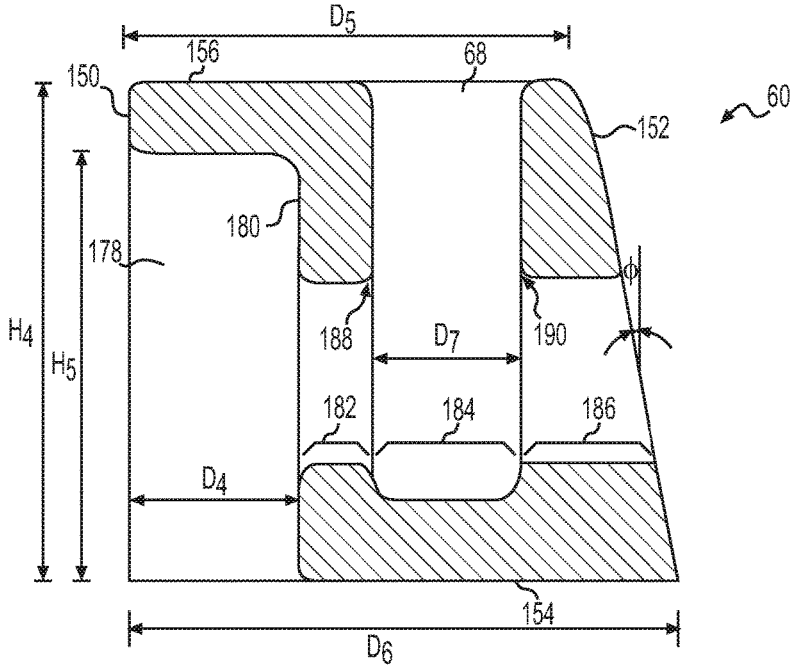
FIG. 8 is a cross-sectional view of the exemplary slide compressor of FIG. 7.

FIG. 8 illustrates a vertical cross-sectional view of slide compressor 60. As illustrated in FIG. 6, compressor rear face 152 of slide compressor 60 may be generally inclined relative to compressor bottom face 154, compressor top face 156, compressor front face 150, and recess base 180. In one exemplary embodiment, compressor rear face 152 may be inclined towards compressor front face 150 so that thickness $D_5$ of slide compressor 60 adjacent compressor top face 156 may be smaller than thickness "$D_6$" of slide compressor 60 adjacent compressor bottom face 154. Angle of inclination φ of compressor rear face 152 relative to a vertical plane disposed generally parallel to compressor rear face 152 may range between about 15° to 30°.

As also illustrated in FIG. 8, first hole portion 182 may be disposed between recess base 180 and slot 68. First hole portion 182 may extend from recess base 180 to first hole portion end 188 disposed adjacent slot 68. First hole portion end 188 may be disposed between recess base 180 and compressor rear face 152. Second hole portion 184 may extend within slot 68 from first hole portion end 188 to second hole portion end 190, which may be disposed between first hole portion end 188 and compressor rear face 152. Third hole portion 186 may be disposed between slot 68 and compressor rear face 152. For example, third hole portion 186 may extend from second hole portion end 190 to compressor rear face 152. As discussed above, first and third hole portions 182, 186 may have a generally circular cross-sections while second hole portion 184 may have a generally non-circular cross-section. Second hole portion 184 may have a width "$D_7$," which may be selected to ensure that nut 62 may be slidably received in second hole portion 184. The non-circular cross-section of second hole portion 184 may help ensure that nut 62 does not rotate when placed within second hole portion 184.

Figure 9:
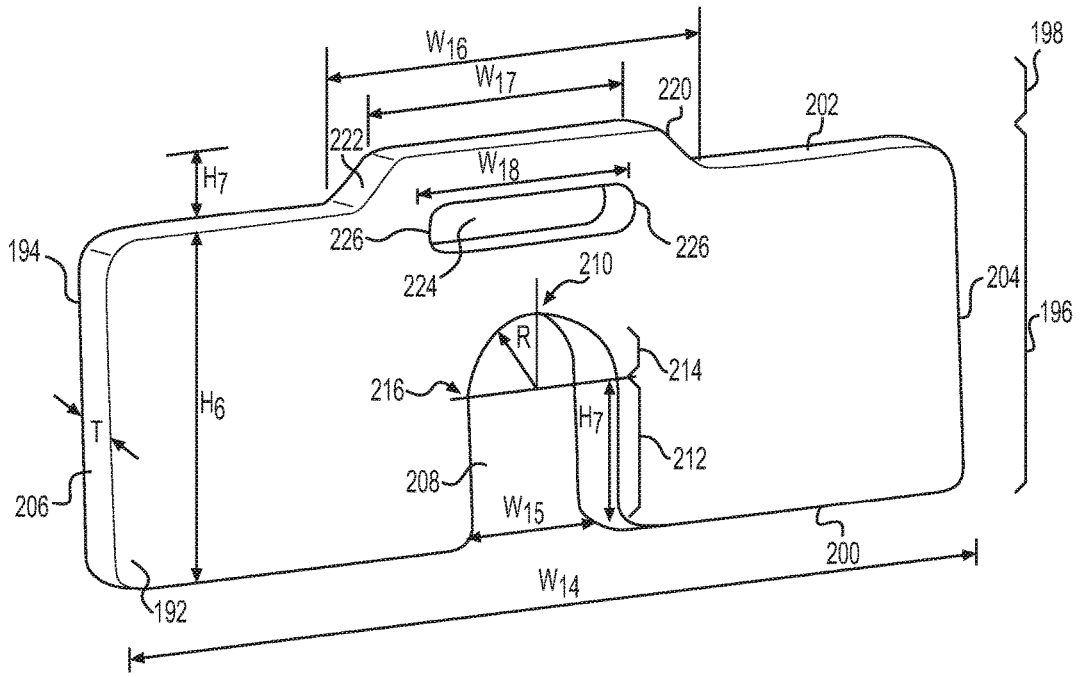
FIG. 9 is a perspective view of an exemplary retainer plate for the shroud retention system of FIG. 2.

FIG. 9 illustrates a perspective view of an exemplary disclosed retainer plate 36. Retainer plate 36 may have a retainer front face 192 disposed opposite retainer rear face 194. Retainer front and rear faces 192, 194 may be disposed generally parallel to each other and may be separated by a thickness T of retainer plate 36. In one exemplary embodiment as illustrated in FIG. 9, thickness T may be generally uniform over an area of retainer front and rear faces 192, 194.

Retainer plate 36 may include retainer portion 196 and pull out portion 198. Retainer portion 196 may have a generally rectangular shape and may include retainer bottom face 200, retainer top face 202, first retainer side face 204, and second retainer side face 206. Retainer bottom face 200 may extend from retainer front face 192 to retainer rear face 194. Retainer bottom face 200 may be disposed generally orthogonal to retainer front and rear faces 192, 194. Retainer top face 202 may extend from retainer front face 192 to retainer rear face 194. Retainer top face 202 may be disposed generally orthogonal to retainer front and rear faces 192, 194. First retainer side face 204 may extend from retainer front face 192 to retainer rear face 194 and between retainer bottom face 200 and retainer top face 202. First retainer side face 204 may be disposed generally orthogonal to retainer front and retainer rear faces 192, 194 and retainer top and bottom faces 200, 202. Likewise, second retainer side face 206 may extend from retainer front face 192 to retainer rear face 194 and extend between retainer bottom face 200 and retainer top face 202. Second retainer side face 206 may be disposed generally orthogonal to retainer front and retainer rear faces 192, 194 and retainer top and bottom faces 200, 202. It is contemplated, however, that retainer front face 192, retainer rear face 194, retainer bottom face 200, retainer top face 202, first retainer side face 204, and second retainer side face 206 may be disposed generally inclined relative to one or more of each other. Retainer portion 196 may have a width "$W_{14}$" between first and second retainer side faces 204, 206 and a height "$H_6$" between retainer bottom face 200 and retainer top face 202.

Retainer portion 196 may include slot 208, which may extend through thickness T from retainer front face 192 to retainer rear face 194. In one exemplary embodiment as illustrated in FIG. 9, slot 208 may be disposed generally midway between first and second retainer side faces 204, 206. Slot 208 may extend from retainer bottom face 200 toward retainer top face 202 to slot end 210, which may be disposed between retainer bottom face 200 and retainer top face 202. Slot 208 may include first slot portion 212 and second slot portion 214. First slot portion 212 may extend from retainer bottom face 200 to first slot portion end 216, which may be disposed between retainer bottom face 200 and slot end 210. First slot portion 212 may be a generally rectangular slot having a width "$W_{15}$" and a height "$H_7$." It is contemplated, however, that first slot portion 212 may have a square shape or any other suitable shape known in the art. Width $W_{15}$ of first slot portion 212 may be smaller than width $W_{14}$ and may be selected so that width $W_{15}$ may be larger than a diameter of bolt 38. Second slot portion 214 may extend from first slot portion end 216 to slot end 210. Second slot portion 214 may have a generally semi-circular shape. In one exemplary embodiment as illustrated in FIG. 9, a radius R of second slot portion 214 may be about half of width $W_{15}$ of first slot portion 212.

Pull out portion 198 may have a generally trapezoidal shape and may extend outward from retainer top face 202 of retainer portion 196. Pull out portion 198 may have a width "$W_{16}$," which may be smaller than width $W_{14}$ of retainer portion 196. Pull out portion 198 may be disposed generally midway between first and second retainer side faces 204, 206 of retainer portion 196. Pull out portion 198 may have a top wall 218, which may extend between retainer front face 192 and retainer rear face 194 of retainer plate 36. Top wall 218 may be disposed generally parallel to retainer top face 202 of retainer portion 196. Top wall 218 may be disposed at a height "$H_7$" above retainer top face 202.

Pull out portion 198 may have first side wall 220 and second side wall 222 disposed opposite first side wall 220. First and second side walls 220, 222 may extend from retainer front face 192 to retainer rear face 194 of retainer plate 36. First and second side walls 220, 222 may be disposed generally orthogonal to retainer front face 192 and retainer rear face 194 of retainer plate 36. First and second side walls 220, 222 may connect top wall 218 of pull out portion 198 with retainer top face 202 of retainer portion 196. First and second side walls 220, 222 may be inclined relative to top wall 218 and retainer top face 202 so that pull out portion 198 may have a generally trapezoidal shape. For example top wall 218 may have a width "$W_{17}$," which may be smaller than width $W_{16}$ of pull out portion 198.

Retainer plate 36 may include slot 224, which may be disposed between slot end 210 and top wall 218. Slot 224 may extend from retainer front face 192 to retainer rear face 194. Slot 224 may have a generally rectangular shape with generally semi-circular shaped slot ends 226. It is contemplated, however, that slot 224 may have an oblong, elliptical, circular, or any other type of shape known in the art. In one exemplary embodiment as illustrated in FIG. 9, slot 224 may be disposed generally orthogonal to slot 208. Slot 224 may have a width "$W_{18}$," which may be equal to, smaller than, or larger than widths $W_{15}$, $W_{16}$, and $W_{17}$. In one exemplary embodiment as illustrated in FIG. 9, slot 224 may be disposed partially in retainer portion 196 and partially in pull out portion 198. It is contemplated, however, that slot 224 may be disposed wholly in one of retainer portion 196 and pull out portion 198.

Figure 10:
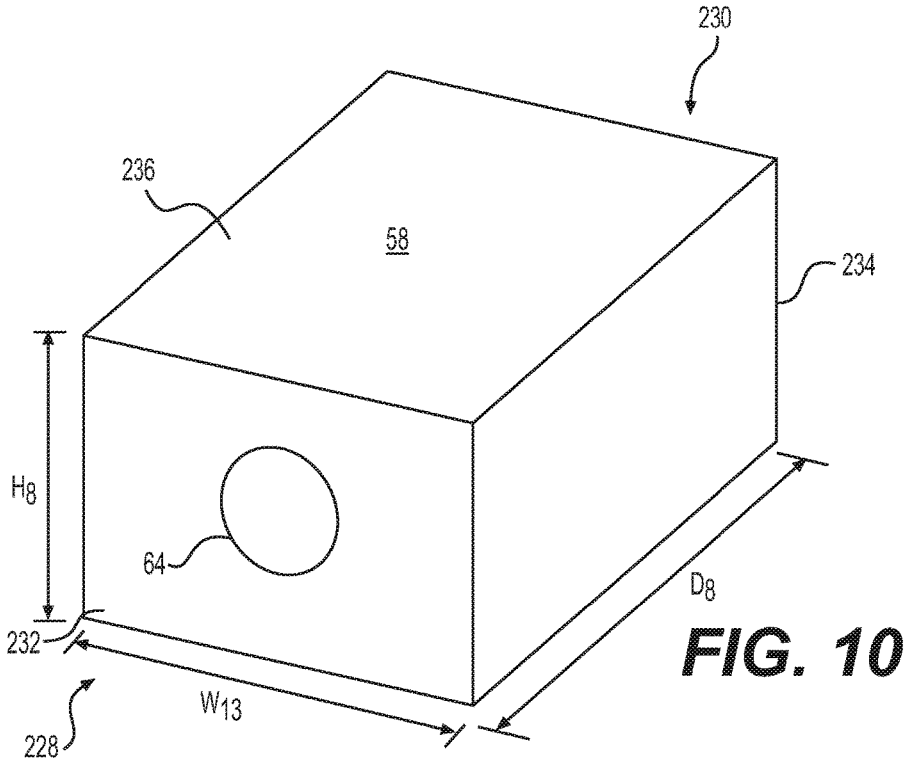
FIG. 10 is a perspective view of an exemplary spring damper for the shroud retention system of FIG. 2.

FIG. 10 illustrates a perspective view of an exemplary disclosed spring damper 58. In one exemplary embodiment as illustrated in FIG. 10, spring damper 58 may have a generally cuboidal shape having width "$W_{19}$," thickness "$D_8$," and height "$H_8$." It is contemplated, however, that spring damper 58 may have a cylindrical, conical, ellipsoidal, frusto-conical, or any other shape known in the art. Spring damper 58 may be configured to be disposed between adapter 32 and slide compressor 60. Spring damper 58 may extend from damper proximal end 228 to damper distal end 230. Spring damper 58 may be configured to be slidably attached to adapter 32 adjacent damper proximal end 228. Likewise, spring damper 58 may be configured to be slidably attached to slide compressor 60 adjacent damper distal end 230.

Spring damper 58 may include damper front face 232, damper rear face 234, and damper sides 236. Damper front face 232 may be disposed adjacent damper proximal end 228. Damper rear face 234 may be disposed opposite and spaced apart from damper front face 232. Damper rear face 234 may be disposed adjacent damper distal end 230. Damper sides 236 may extend from damper front face 232 to damper rear face 234. Damper front face 232 may be disposed generally parallel to damper rear face 234. Damper sides 236 may be disposed generally orthogonal to damper front face 232 and damper rear face 234.

Damper front face 232 may have a generally rectangular shape, although other shapes are also contemplated. A size of damper front face 232 may be selected so that damper front face 232 may be receivable in recess 140 of adapter 32. Damper front face 232 may be configured to abut against recess base 142 of recess 140. Damper rear face 234 may have a generally rectangular shape, although other shapes are also contemplated. A size of damper rear face 234 may be selected so that damper rear face 234 may be receivable in recess 178 of slide compressor 60. Damper rear face 234 may be configured to abut against recess base 180 of recess 178.

Spring damper 58 may include hole 64, which may extend from damper front face 232 to damper rear face 234. Hole 64 may be a through hole. It is contemplated that hole 64 may be tapped to threadingly receive bolt 38. Spring damper 58 may be made of elastomeric material, which may be configured to be compressed between adapter 32 and slide compressor 60. Additionally, or alternatively, spring damper 58 may include one or more spring members (not shown) disposed between damper front face 232 and damper rear face 234.

Figure 11:
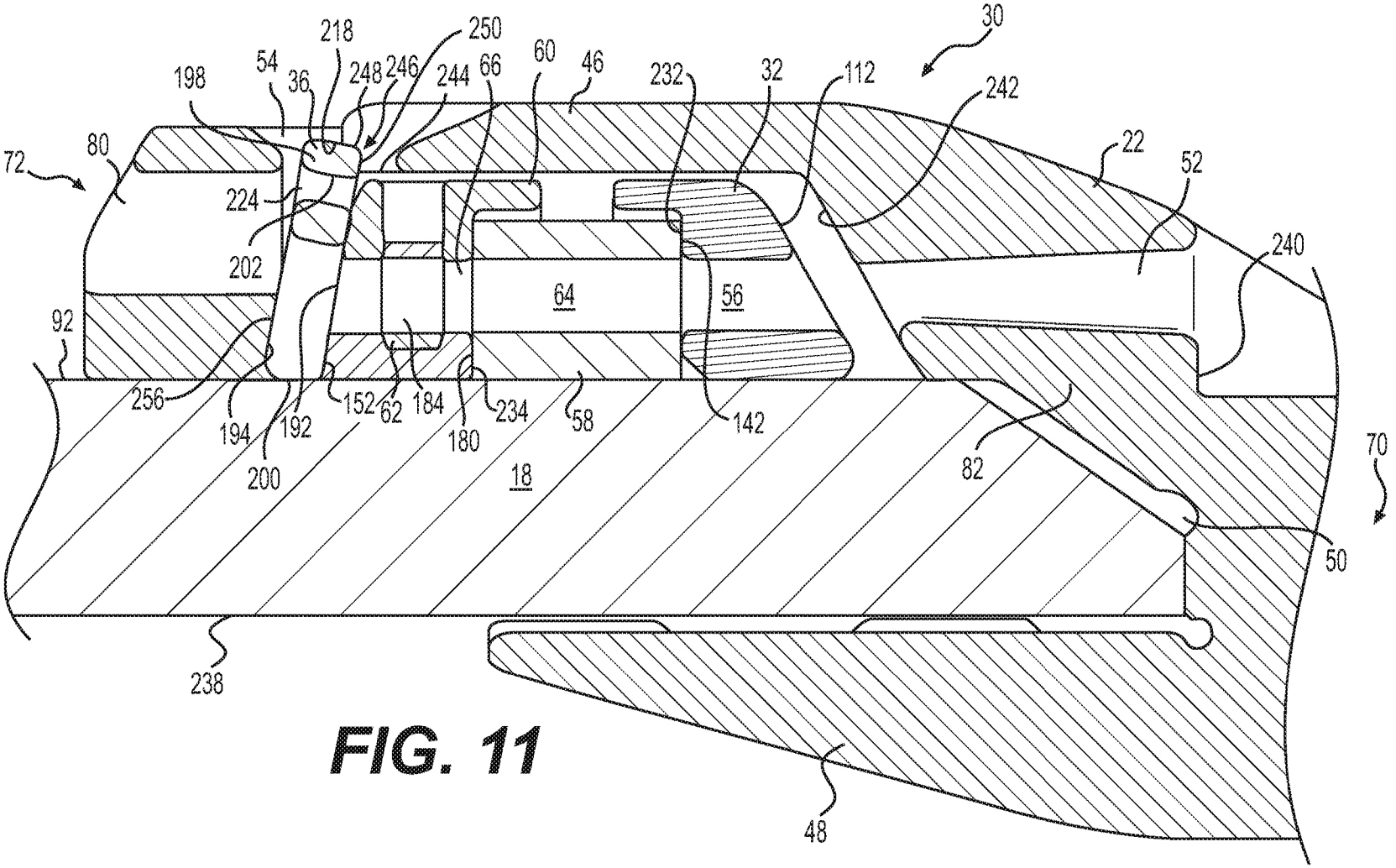
FIG. 11 is a cross-sectional view of the exemplary shroud retention system of FIG. 2.

FIG. 11 illustrates a cross-sectional view of an exemplary disclosed shroud retention system 30. As illustrated in FIG. 11, in an assembled configuration, lower leg 48 of shroud 22 may be disposed adjacent lower surface 238 of edge 18 of work tool 10. Upper leg 46 may be disposed adjacent upper surface 92 of edge 18, which may be disposed in opening 50 between upper leg 46 and lower leg 48. Further, adapter 32 may be disposed on upper surface 92 of edge 18. In some exemplary embodiments, adapter 32 may be fixedly attached to edge 18 via welded joints, fasteners, or using any other means of attachment known in the art. Adapter 32 may be disposed within channel 80, which may slidably engage with adapter 32. Channel front wall 82 of channel 80 may have an outer surface 240 and an inner surface 242. Hole 52 in attachment portion 42 of shroud 22 may extend from outer surface 240 to inner surface 242 of channel front wall 82. Adapter front face 112 of adapter 32 may be disposed opposite inner surface 242 of channel 80.

Slide compressor 60 may also be disposed within channel 80, which may slidably engage with slide compressor 60. As illustrated in FIG. 11, spring damper 58 may be disposed between adapter 32 and slide compressor 60 within channel 80. Damper front face 232 of spring damper 58 may be disposed opposite recess base 142 of recess 140 of adapter 32. Damper front face 232 may abut against recess base 142. Damper rear face 234 of spring damper 58 may be disposed opposite recess base 180 of recess 178 of slide compressor 60. Damper rear face 234 may abut against recess base 180. Holes 52, 56, 64, and 66 in shroud 22, adapter 32, spring damper 58, and slide compressor 60, respectively, may be axially aligned with nut 62 disposed in slot 68 of slide compressor 60, and may be configured to receive bolt 38.

Nut 62 may be disposed within second hole portion 184 of hole 66. As also illustrated in FIG. 11, retainer plate 36 may be disposed within channel 80 in a locked position. For example, retainer plate 36 may be disposed in channel 80 such that retainer front face 192 may abut against compressor rear face 152 of slide compressor 60. Top wall 84 of channel 80 may include channel inner surface 244, which may include notch 246. Notch 246 may be disposed adjacent opening 54 between opening 54 and hole 52. Notch 246 may include notch upper wall 248 and notch base wall 250. Pull out portion 198 of retainer plate 36 may slidably engage with notch 246 adjacent retainer top face 202. Top wall 218 of pull out portion 198 of retainer plate 36 may abut against notch upper wall 248, and retainer front face 192 of retainer plate 36 may abut against notch base wall 250.

Figure 12:
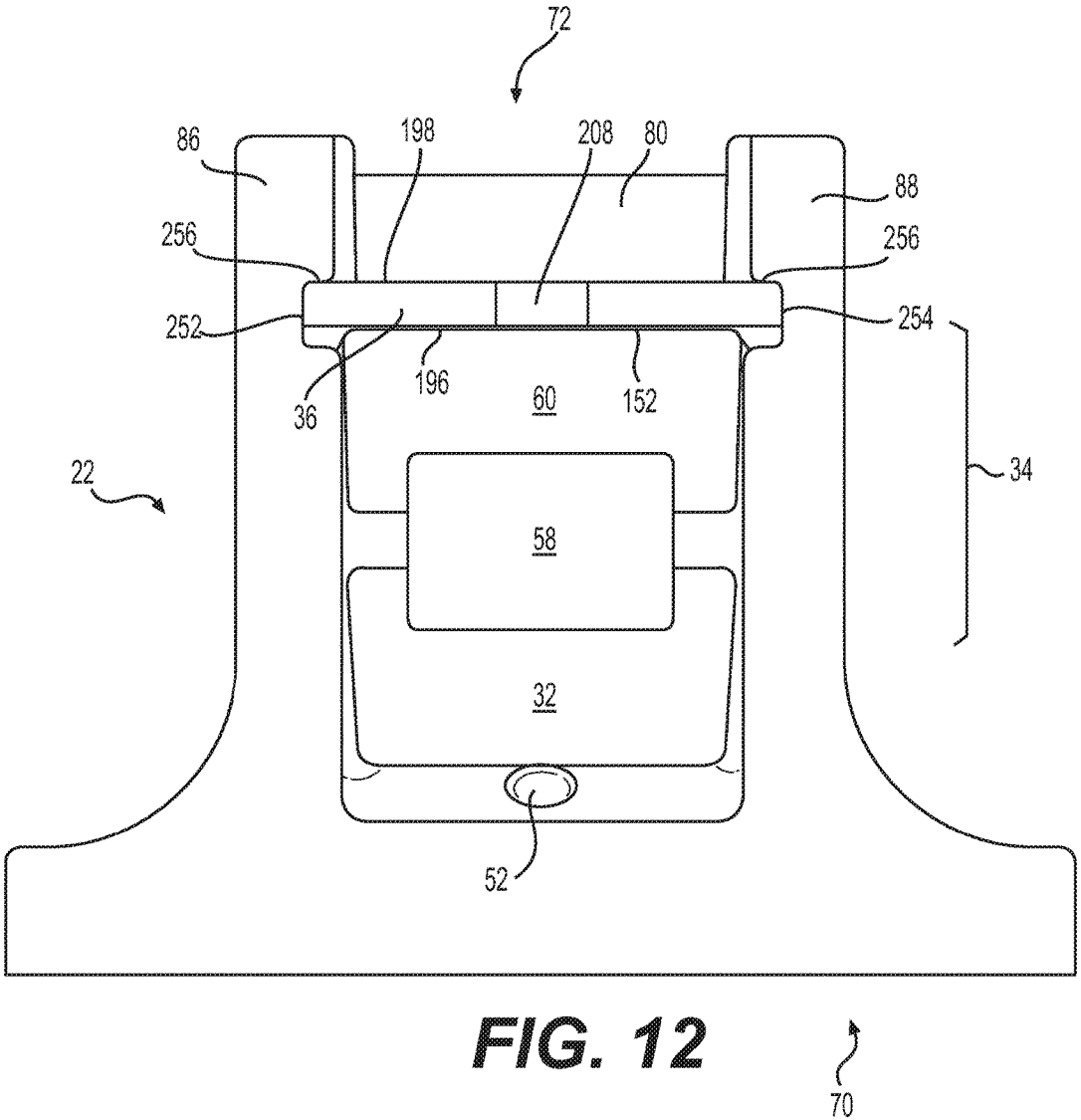
FIG. 12 is a bottom view of the exemplary shroud retention system of FIG. 2.

FIG. 12 illustrates a bottom view of an exemplary disclosed shroud retention system 30. As illustrated in FIG. 12, retainer plate 36 may be slidably attached to first and second legs 86, 88 of channel 80 and may be configured to retain spring assembly 34 between adapter 32 and retainer plate 36. Front face 196 of retainer plate 36 may abut compressor rear face 152 of slide compressor 60. As further illustrated in FIG. 12, first leg 86 of channel 80 may include first retainer slot 252 and second leg 88 of channel 80 may include second retainer slot 254. First retainer slot 252 may extend from opening 54 in top wall 84 of channel 80 to adjacent upper surface 92 (see dashed line in FIG. 4). Likewise, second retainer slot 254 may extend from opening 54 in top wall 84 of channel 80 adjacent upper surface 92 of edge 18 to top wall 84 of channel 80 (see dashed line in FIG. 4). First and second retainer slots 252, 254 and opening 54 may allow retainer plate 36 to be inserted through opening 54 and be disposed in first and second retainer slots 252, 254.

Returning to FIG. 11, in a locked position, pull out portion 198 of retainer plate 36 may slidably engage with notch 246 in top wall 84 of channel 80 and retainer portion 196 of retainer plate 36 may abut against retainer slot walls 256 adjacent retainer bottom face 200. In one exemplary embodiment as illustrated in FIG. 11, when retainer plate 36 is in its locked position, retainer rear face 194 may abut against retainer slot walls 256 of first and second retainer slots 252, 254 adjacent retainer bottom face 200. Thus in the locked position, pull out portion 198 of retainer plate 36 may slidably engage with notch 246. Simultaneously, retainer rear face 194 may engage with retainer slot walls 256 of first and second retainer slots 252, 254. In particular, the biasing force of spring damper 58 may help compressor rear face 152 move retainer plate 36 into its inclined and locked position within channel 80 as illustrated in FIG. 11.

Figure 13:
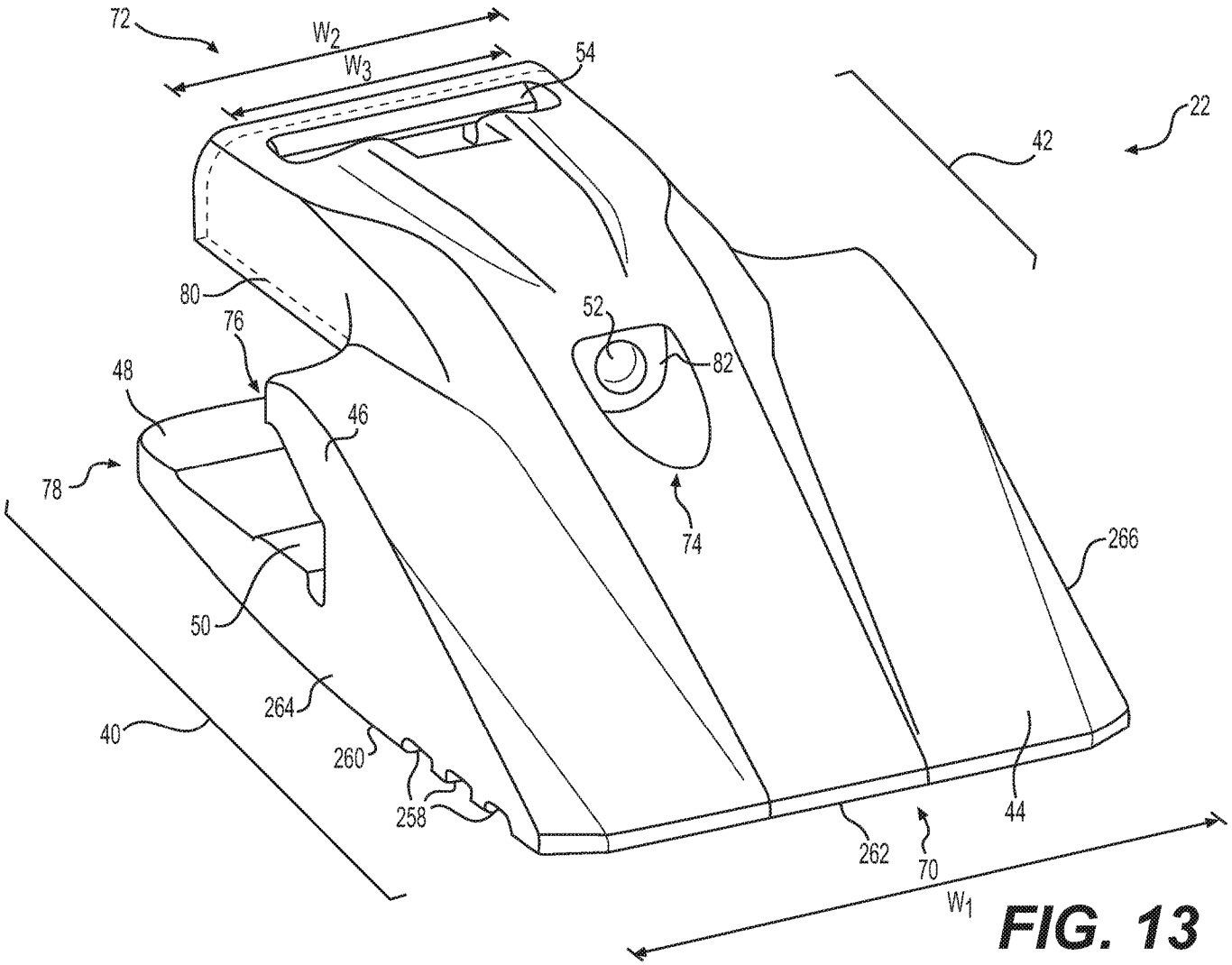
FIG. 13 is a perspective view of another exemplary shroud for the shroud retention system of FIG. 2.

FIG. 13 illustrates a perspective view of another exemplary embodiment of shroud 22. In addition to the features of shroud 22 discussed above with respect to FIG. 3, shroud 22 may also include one or more grooves 258 disposed on lower surface 260 of tip 44. Lower surface 260 may extend from tip edge 262, which may be disposed adjacent shroud proximal end 70, to adjacent lower leg distal end 78. Grooves 258 may be disposed adjacent tip edge 262 and may extend between first side face 264 of shroud 22 and second side face 266, which may be disposed opposite first side face 264. In one exemplary embodiment as illustrated in FIG. 13, grooves 258 may have a width equal to width $W_1$ of tip 44. Although FIG. 13 illustrates shroud 22 with three grooves 258, it is contemplated that shroud 22 may include any number of grooves 258, which may be spaced from each other at equal or unequal distances. It is also contemplated that grooves 258 may be disposed parallel to or inclined relative to tip edge 262. Each groove 258 may have a generally rectangular shaped cross-section. Grooves 258 may be configured to slidingly or interferingly receive abrasion resistant materials, which may be attached to shroud 22 via fasteners, rivets, welded or brazed joints, or by any other method of attachment known in the art.

Figure 14:
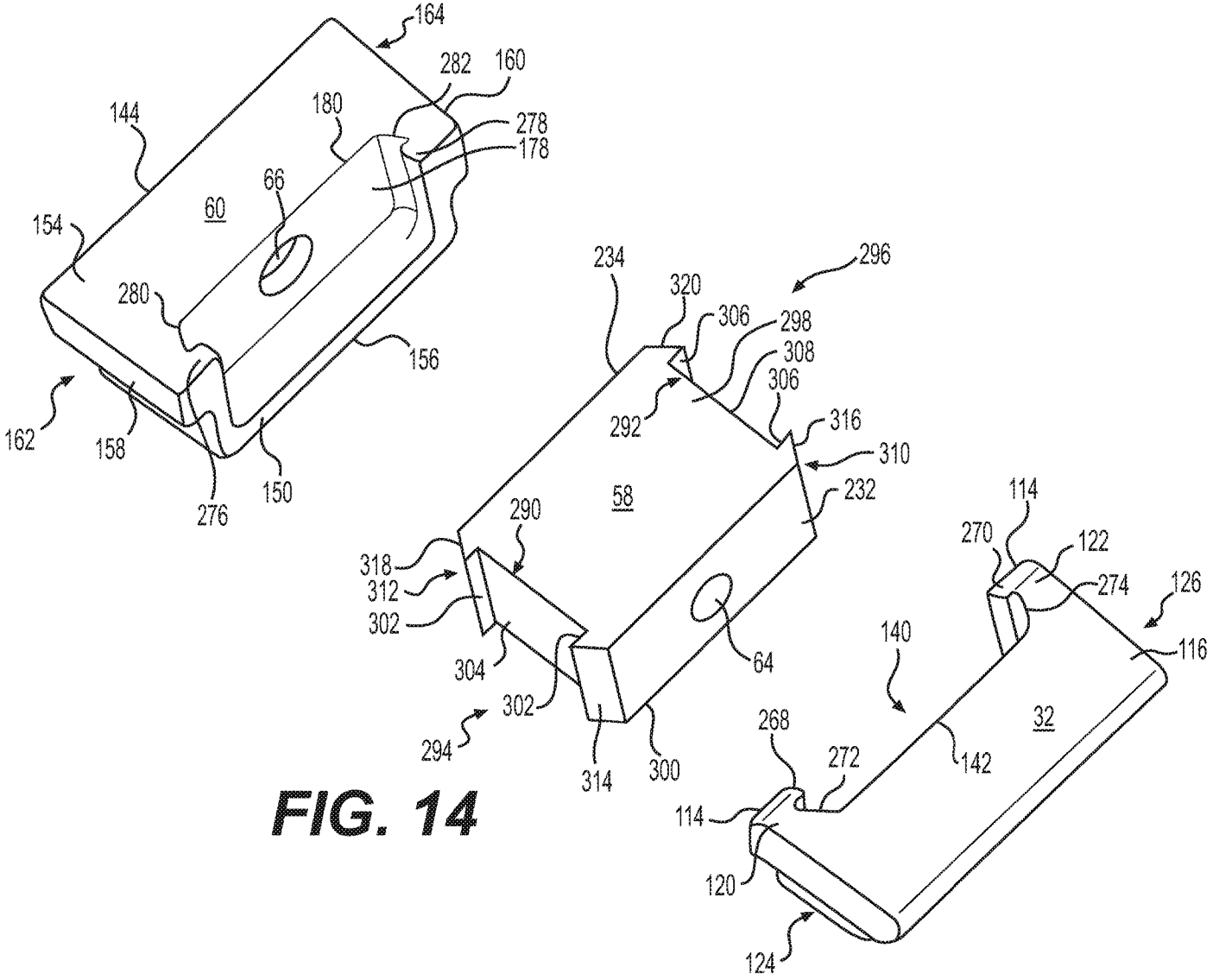
FIG. 14 is a perspective bottom view of an exemplary adapter, spring damper, and slide compressor for the shroud retention system of FIG. 2.

FIG. 14 illustrates a perspective bottom view of exemplary embodiments of adapter 32, spring damper 58, and slide compressor 60. As illustrated in FIG. 14, in addition to the features of adapter 32 described above with respect to FIGS. 2, 5, and 6, adapter 32 may include a dovetail shaped recess 140 between adapter rear face 114 and recess base 142. For example, adapter 32 may include first adapter lip 268 disposed on first side 124 of adapter 32 and second adapter lip 270 disposed on second side 126 of adapter 32. First adapter lip 268 may extend into recess 140 from first adapter side wall 120 towards second adapter side wall 122. Likewise, second adapter lip 270 may extend into recess 140 from second adapter side wall 122 towards first adapter side wall 120. First and second adapter lips 268, 270 may extend from adapter bottom face 116 and may have a height $H_3$ (see FIG. 3). As also illustrated in FIG. 14, recess 140 may include first side wall 272 disposed on first side 124 and second side wall 274 disposed on second side 126. First side wall 272 may extend between recess base 142 and first adapter lip 268. Likewise second side wall 274 may extend between recess base 142 and second adapter lip 270. First and second side walls 272, 274 may be disposed generally orthogonal to adapter bottom face 116. First and second side walls 272, 274 may be inclined relative to recess base 142 and relative to each other. First and second adapter lips 268, 270, first and second side walls 272, 274, and recess base 142 may form a generally dovetail shaped recess 140 in adapter 32.

As also illustrated in FIG. 14, in addition to the features of slide compressor 60 described above with respect to FIGS. 2, 7, and 8, slide compressor 60 may include a dovetail shaped recess 178 between compressor front face 150 and recess base 180. For example, slide compressor 60 may include first compressor lip 276 disposed on first side 162 of slide compressor 60 and second compressor lip 278 disposed on second side 164 of slide compressor 60. First compressor lip 276 may extend into recess 178 from first compressor side wall 158 towards second compressor side wall 160. Likewise, second compressor lip 278 may extend into recess 178 from second compressor side wall 160 towards first compressor side wall 158. First and second compressor lips 276, 278 may extend from compressor bottom face 154 and may have a height $H_5$ (see FIG. 6 and second side wall 282 disposed on second side 164. First side wall 280 may extend between recess base 180 and first compressor lip 276. Likewise second side wall 282 may extend between recess base 180 and second compressor lip 278. First and second side walls 280, 282 may be disposed generally orthogonal to compressor bottom face 154. First and second side walls 280, 282 may be inclined relative to recess base 180 and relative to each other. First and second compressor lips 276, 278, first and second side walls 280, 282, and recess base 180 may form a generally dovetail shaped recess 178 in slide compressor 60.

As further illustrated in FIG. 14, in addition to the features of spring damper 58 described above with respect to FIGS. 2 and 10, spring damper 58 may include first damper channel 290 and second damper channel 292. First damper channel 290 may be disposed on first side 294 of spring damper 58 and second damper channel may be disposed on second side 296 opposite first side 294. First side 294 of spring damper 58 may be disposed adjacent first side 124 of adapter 32 and first side 162 of slide compressor 60. Likewise, second side 296 of spring damper 58 may be disposed adjacent second side 126 of adapter 32 and second side 164 of slide compressor 60.

First damper channel 290 may extend from spring damper base 298 to spring damper top face 300. As illustrated in FIG. 14, spring damper base 298 may be disposed generally coplanar with adapter bottom face 116 and compressor bottom face 154. First damper channel 290 may have side walls 302 and first channel base 304. Side walls 302 and first channel base 304 may be disposed generally orthogonal to spring damper base 298 and spring damper top face 300. Side walls 302 may be disposed generally parallel to each other and generally orthogonal to first channel base 304. Second damper channel 292 may extend from spring damper base 298 to spring damper top face 300. Second damper channel 292 may have side walls 306 and second channel base 308. Side walls 306 and second channel base 308 may be disposed generally orthogonal to spring damper base 298 and spring damper top face 300. Side walls 306 may be disposed generally parallel to each other and generally orthogonal to second channel base 308.

As also illustrated in FIG. 14, adapter 32 may include first dovetail mortice 310 and second dovetail mortice 312. First dovetail mortice 310 may extend from damper front face 232 to side walls 302, 306 of first and second damper channels 290, 292, respectively. First dovetail mortice 310 may include mortice side walls 314, 316, which may extend from spring damper base 298 to spring damper top face 300. Mortice side wall 314 may be disposed on first side 294 and may extend from damper front face 232 to side wall 302 of first damper channel 290. Mortice side wall 316 may be disposed on second side 296 and may extend from damper front face 232 to side wall 306 of second damper channel 292. Mortice side walls 314, 316 may be disposed generally orthogonal to spring damper base 298 and spring damper top face 300. Mortice side walls 314, 316 may be generally inclined to each other. Damper front face 232, side walls 302, 306, and mortice side walls 314, 316 may give first dovetail mortice 310 a dovetail mortice shape. First dovetail mortice 310 may be configured to engage with dovetail shaped recess 140 in adapter 32 such that side wall 302 of first dovetail mortice 310 may engage with first adapter lip 268 and side wall 306 may engage with second adapter lip 270.

Second dovetail mortice 312 may extend from damper front face 232 to side walls 302, 306 of first and second damper channels 290, 292, respectively. Second dovetail mortice 312 may include mortice side walls 318, 320, which may extend from spring damper base 298 to spring damper top face 300. Mortice side wall 318 may be disposed on first side 294 and may extend from damper rear face 234 to side wall 302 of first damper channel 290. Mortice side wall 320 may be disposed on second side 296 and may extend from damper rear face 234 to side wall 306 of second damper channel 292. Mortice side walls 318, 320 may be disposed generally orthogonal to spring damper base 298 and spring damper top face 300. Mortice side walls 318, 320 may be generally inclined to each other. Damper rear face 232, side walls 302, 306, and mortice side walls 318, 320 may give second dovetail mortice 312 a dovetail mortice shape. Second dovetail mortice 312 may be configured to engage with dovetail shaped recess 178 in slide compressor 60 such that side wall 302 of second dovetail mortice 312 may engage with first compressor lip 276, and side wall 306 may engage with second compressor lip 278.

INDUSTRIAL APPLICABILITY

The disclosed shroud retention system may be used with various earth-working machines, such as hydraulic excavators, cable shovels, wheel loaders, front shovels, draglines, and bulldozers. Specifically, the shroud retention system may be used to connect shrouds to work tools of these machines to help protect the work tool edges against wear. A method of retaining shroud 22 on work tool 10 will be described next.

Figure 15:
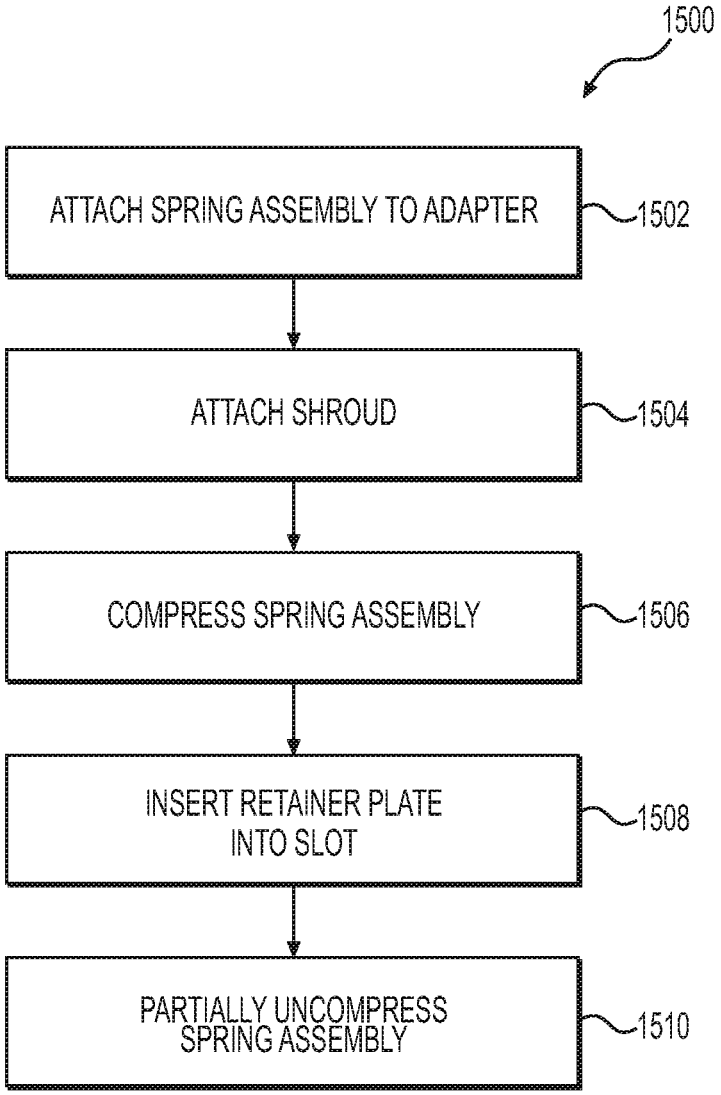
FIG. 15 is a flow-chart of an exemplary method of retaining the shroud of FIG. 3 using the shroud retention system of FIG. 2.

FIG. 15 illustrates a method 1500 of retaining shroud 22 on work tool 10. Method 1500 may include a step of attaching spring assembly 34 to adapter 32 (Step 1502). To attach spring assembly 34 to adapter 32, spring damper 58 may be slidably inserted in recess 140 of adapter 32 adjacent damper proximal end 228 such that damper front face 232 abuts against recess base 142 of adapter 32. For example, spring damper 58 may be placed adjacent adapter rear face 114 and may be pushed towards adapter 32 so that first dovetail mortice 310 may engage with first and second adapter lips 268, 270. Further, slide compressor 60 may slidably attached to spring damper 58 adjacent damper distal end 230 such that damper rear face 234 abuts against recess base 180 of slide compressor 60. In one exemplary embodiment, recess 178 of slide compressor 60 may be slidably engaged with second dovetail mortice 312 of spring damper 58 by engaging second dovetail mortice 312 and recess 178 adjacent spring damper top face 300. Slide compressor 60 may be slidingly pushed downward toward spring damper base 298 so that second dovetail mortice 312 of spring damper 58 engages with first and second compressor lips 276, 278. Nut 62 may be inserted into slot 68 of slide compressor 60 so that nut 62 is disposed in second hole portion 184 of hole 66 in slide compressor 60.

Method 1500 may include a step of attaching shroud 22 (Step 1504). Attachment portion 42 of shroud 22 may be positioned and pushed rearward toward edge 18 so that adapter 32 and spring assembly 34 may be slidably received in channel 80 of attachment portion 42 of shroud 22. Thus, for example, shroud 22 may be attached such that first and second projections 108, 110 of adapter 32 and first and second projections 146, 148 of slide compressor 60 may be slidably received in lower recess 96 of channel 80. Likewise, first and second upper side faces 134, 138 of adapter 32 and first and second upper side faces 172, 176 of slide compressor 60 may be slidably received within upper recess 98 of channel 80.

Method 1500 may include a step of compressing spring assembly 34 (Step 1506). To compress spring assembly 34, bolt 38 may be inserted through holes 52, 56, 64, 66 of shroud 22, adapter 32, spring damper 58, and slide compressor 60, respectively, so that bolt 38 threadingly engages with nut 62 in slide compressor 60. Turning bolt 38 may cause slide compressor 60 to slidably move towards adapter 32, compressing spring damper 58. Bolt 38 may be turned until opening 54 in attachment portion 42 of shroud 22 is located rearward of compressor rear face 152 of slide compressor 60. In this condition, opening 54 may be disposed between compressor rear face 152 of slide compressor 60 and shroud distal end 72.

Method 1500 may include a step of inserting retainer plate 36 into opening 54 (Step 1508). Retainer plate 36 may be pushed into opening 54 so that first and second retainer side faces 204, 206 slidably engage with first and second retainer slots 252, 254. Retainer plate 36 may be pushed in through opening 54 until retainer bottom face 200 abuts against upper surface 92 of edge 18. Retainer plate 36 may in an unlocked position when inserted in this manner through opening 54 because it may be possible to pull retainer plate 36 out of opening 54.

Method 1500 may include a step of partially uncompressing spring assembly 34 (Step 1510). To partially uncompress spring assembly 34, bolt 38 may be turned to loosen bolt 38 from nut 62. Turning bolt 38 in this manner may allow slide compressor 60 to move away from adapter 32, uncompressing spring damper 58. As bolt 38 is turned to uncompress spring assembly 34, spring damper 58 may exert a biasing force on slide compressor 60 pushing slide compressor 60 away from adapter 32. The biasing force of spring damper 58 may cause compressor rear face 152 of slide compressor 60 to push retainer front face 192 of retainer plate 36 so that retainer plate 36 may be tilted into its locked position. Tilting retainer plate 36 may cause retainer plate 36 to slidingly engage with notch 246 in channel 80 of shroud 22. Thus, retainer front face 192 of retainer plate 36 may abut against notch base wall 250 and top wall 218 of pull out portion 198 of retainer plate 36 may abut against notch upper wall 248. The biasing force of spring damper 58 and the angle of inclination of compressor rear face 152 of slide compressor 60 may help push retainer plate 36 against notch 246, preventing retainer plate 36 from being ejected out of opening 54. Likewise, the biasing force of spring damper 58 and the angle of inclination of compressor rear face 152 may help retainer rear face 194 abut against retainer slot walls 256 adjacent retainer bottom face 200. Thus, by partially uncompressing spring damper 58 to push retainer plate 36 into a locked position, retention system 30 may allow shroud 22 to be attached to work tool 10 without the use of any fasteners.

In one exemplary embodiment, bolt 38 may be completely removed from retention system 30. Bolt 38 may be reusable for assembly and/or disassembly of one or more shroud 22 on the same work tool 10. Further, by using a single spring damper 58 as the compressible element, retention system 30 may help reduce the number of components in the assembly, which may help reduce the cost of operating work tool 10. In addition, because assembly of shroud 22 using the disclosed shroud retention system 30 requires only a linear movement of channel 80 to slidably receive adapter 32 and slide compressor 60, shroud retention system 30 may help simplify the assembly process for shrouds 22 at a work site.

To remove shroud 22 from work tool 10, a pry bar may be inserted through opening 54 to push retainer front face 192 of retainer plate 36 rearward so that retainer front face 192 and retainer top face 202 of retainer plate 36 may disengage from notch base wall 250 and notch upper wall 248, respectively. The pry bar may then be inserted into slot 224 in retainer plate 36 to pull retainer plate 36 out of opening 54. In one exemplary embodiment, by engaging with dovetail shaped recesses 140 and 178, first and second dovetail mortices 310, 312, respectively, of spring damper 58 may prevent slide compressor 60 from being ejected rearward due to the biasing force of spring damper 58 when retailer plate 36 is removed from slot 224. Once retainer plate 36 has been removed, shroud 22 may be slidably disengaged from slide compressor 60 and adapter 32 by pulling shroud 22 towards shroud proximal end 70 and away from edge 18 of work tool 10.

It will be apparent to those skilled in the art that various modifications and variations can be made to the disclosed shroud retention system. Other embodiments will be apparent to those skilled in the art from consideration of the specification and practice of the disclosed shroud retention system. It is intended that the specification and examples be considered as exemplary only, with a true scope being indicated by the following claims and their equivalents.

What is claimed is:

1. A slide compressor for attaching a work tool, the slide compressor comprising:
- a central block, including:
- a compressor front face;
- a compressor rear face disposed opposite the compressor front face, the compressor rear face being inclined relative to the compressor front face;
- a compressor bottom face extending between the compressor front face and the compressor rear face;
- a compressor top face disposed opposite the compressor bottom face and extending between the compressor front face and the compressor rear face;
- a hole extending between the compressor front face and the compressor rear face;
- a slot extending from the compressor top face towards the compressor bottom face and intersecting with the hole; and
- a recess extending from the compressor front face towards the compressor rear face, the recess including a recess base, the hole extending from the recess base to the compressor rear face, wherein the recess has a generally dovetail shape.

2. The slide compressor of claim 1, wherein the hole includes:
- a first hole portion disposed between the recess base and the slot;
- a second hole portion disposed in the slot; and
- a third hole portion disposed between the slot and the compressor rear face, wherein the first and third hole portions have generally circular cross-sections and the second hole portion has a non-circular cross-section configured to receive a nut.

3. The slide compressor of claim 1, further including:
- a first side wall extending between the compressor front face and the compressor rear face;
- a second side wall extending between the compressor front face and the compressor rear face;
- a first projection extending outward from the first side wall; and
- a second projection extending outward from the second side wall.

4. The slide compressor of claim 3, wherein
- the first projection includes a first lower side face extending between the compressor bottom face and a first projection end disposed between the compressor bottom face and the compressor top face,
- the second projection includes a second lower side face extending between the compressor bottom face and a second projection end disposed between the compressor bottom face and the compressor top face, and
- the first lower side face is inclined relative to the second lower side face.

5. The slide compressor of claim 1, wherein the compressor rear face is inclined relative to the compressor front face.

6. The slide compressor of claim 5, wherein an angle of inclination of the rear face ranges between about 15° and about 30°.

7. A slide compressor for attaching a work tool, the slide compressor comprising:
- a central block, including:
- a compressor front face;
- a compressor rear face disposed opposite the compressor front face, the compressor rear face being inclined relative to the compressor front face;
- a compressor bottom face extending between the compressor front face and the compressor rear face;
- a compressor top face disposed opposite the compressor bottom face and extending between the compressor front face and the compressor rear face;
- a hole extending between the compressor front face and the compressor rear face;
- a slot extending from the compressor top face towards the compressor bottom face and intersecting with the hole;
- a first side wall extending between the compressor front face and the compressor rear face;
- a second side wall extending between the compressor front face and the compressor rear face;
- a first projection extending outward from the first side wall; and
- a second projection extending outward from the second side wall, wherein
- the first projection includes a first lower side face extending between the compressor bottom face and a first projection end disposed between the compressor bottom face and the compressor top face,
- the second projection includes a second lower side face extending between the compressor bottom face and a second projection end disposed between the compressor bottom face and the compressor top face, and
- the first lower side face is inclined relative to the second lower side face.

8. The slide compressor of claim 7, further including a recess extending from the compressor front face towards the compressor rear face, the recess including a recess base, the hole extending from the recess base to the compressor rear face.

9. The slide compressor of claim 7, wherein the hole includes:

a first hole portion disposed between the recess base and the slot;

a second hole portion disposed in the slot; and a third hole portion disposed between the slot and the compressor rear face, wherein the first and third hole portions have generally circular cross-sections and the second hole portion has a non-circular cross-section configured to receive a nut.

10. The slide compressor of claim 7, wherein the recess has a generally dovetail shape.

11. The slide compressor of claim 7, wherein the compressor rear face is inclined relative to the compressor front face.

12. The slide compressor of claim 11, wherein an angle of inclination of the rear face ranges between about 15° and about 30°.

* * * * *